US006290634B1

(12) United States Patent
Lombardo et al.

(10) Patent No.: US 6,290,634 B1
(45) Date of Patent: Sep. 18, 2001

(54) PRESSURE SEAL FORM CONFIGURATIONS WHICH REDUCE PRINTER JAMS

(75) Inventors: Leo Lombardo, Manchester; Wayne Charles Peterson, Hooksett, both of NH (US)

(73) Assignee: Moore North America, Inc., NY (US)

( * ) Notice: Subject to any disclaimer, the term of this patent is extended or adjusted under 35 U.S.C. 154(b) by 475 days.

(21) Appl. No.: 09/085,021

(22) Filed: May 28, 1998

Related U.S. Application Data

(60) Division of application No. 08/845,837, filed on Apr. 28, 1997, now Pat. No. 5,829,670, which is a continuation-in-part of application No. 08/690,546, filed on Jul. 31, 1996, now Pat. No. 5,785,242.

(51) Int. Cl.[7] ..... B31B 1/88; B31B 1/26
(52) U.S. Cl. ..... 493/188; 493/243
(58) Field of Search ..... 493/216, 921, 493/188, 267, 254, 243; 53/460, 206, 411, 131.5, 131.4

(56) References Cited

U.S. PATENT DOCUMENTS

| | | | | |
|---|---|---|---|---|
| 4,380,315 | * | 4/1983 | Steidinger | 229/69 |
| 4,824,142 | | 4/1989 | Dossche . | |
| 4,860,945 | * | 8/1989 | Breen | 493/216 |
| 4,896,823 | | 1/1990 | Taylor . | |
| 4,918,128 | | 4/1990 | Sakai . | |
| 4,972,655 | * | 11/1990 | Ogawa | 493/216 |
| 5,005,337 | * | 4/1991 | Kluth | 53/460 |
| 5,067,305 | * | 11/1991 | Baker et al. | 53/460 |
| 5,167,739 | | 12/1992 | Hutchinson et al. . | |
| 5,174,491 | * | 12/1992 | Taylor et al. | 229/92.1 |
| 5,174,493 | | 12/1992 | File . | |
| 5,201,464 | | 4/1993 | File . | |
| 5,207,592 | * | 5/1993 | Loch | 493/216 |
| 5,238,178 | | 8/1993 | Hutchinson et al. . | |
| 5,263,637 | * | 11/1993 | Simson | 493/921 |
| 5,290,225 | * | 3/1994 | Younger | 493/921 |
| 5,294,041 | | 3/1994 | Whiteside . | |
| 5,314,110 | | 5/1994 | Lombardo . | |
| 5,318,324 | | 6/1994 | Lombardo et al. . | |
| 5,334,571 | | 8/1994 | Baxter . | |
| 5,346,123 | | 9/1994 | Lombardo . | |
| 5,360,159 | * | 11/1994 | Perriman | 229/92.3 |
| 5,366,145 | | 11/1994 | Sauerwine . | |
| 5,376,048 | * | 12/1994 | Whiteside | 229/92.1 X |
| 5,397,427 | | 3/1995 | Traise et al. . | |
| 5,409,752 | | 4/1995 | Juteau . | |
| 5,419,590 | | 5/1995 | Rothschild . | |
| 5,427,851 | | 6/1995 | Mehta . | |
| 5,437,476 | | 8/1995 | Hutchinson . | |
| 5,472,240 | | 12/1995 | Davies . | |
| 5,553,774 | | 9/1996 | Goodno . | |

FOREIGN PATENT DOCUMENTS

| | | | | |
|---|---|---|---|---|
| 2252792 | * | 6/1975 | (FR) | 229/92.1 |

* cited by examiner

*Primary Examiner*—Brian L. Johnson
*Assistant Examiner*—Matthew Luby
(74) *Attorney, Agent, or Firm*—Nixon & Vanderhye PC

(57) ABSTRACT

A business form intermediate with pressure activated cohesive in separable side margins is otherwise conventional except for the particular patterns of cohesive. The patterns prevent cupping (i.e. flexing or distortion) of the vertical edges. Substantially straight line series of substantially rectangular spots having dimensions about ¼ inch by ⅛ inch, and spaced from each other about ½ inch, are preferably provided, along the vertical (side) edges of the intermediate on at least one face, and preferably both faces (not staggered horizontally, but not significantly vertically overlapping, from one face to the other).

5 Claims, 8 Drawing Sheets

PRESSURE SEAL FORM CONFIGURATIONS WHICH REDUCE PRINTER JAMS

This is a divisional of application Ser. No. 08/845/837, filed Apr. 28, 1997, now U.S. Pat. No. 5,829,670 Which In Turn Is A Continuation-In-Part Of Ser. No. 08/690,546 Filed Jul 31, 1996 now U.S. Pat. No. 5,785,242.

BACKGROUND AND SUMMARY OF THE INVENTION

Mailer type business forms which utilize pressure sensitive cohesive are becoming increasingly popular. Pressure sensitive cohesive in its commercial form typically is a styrene-natural rubber copolymer composition, such as shown in U.S. Pat. No. 4,918,128 and 5,427,851. Various other forms that the pressure sensitive cohesive may take, including commercial formulations thereof, are disclosed in U.S. Pat. No. 5,201,464 (the disclosure of which is hereby incorporated by herein). In the utilization of the mailer type business form intermediate which includes a pressure cohesive, cooperating patterns of cohesive are provided on cooperating faces of the intermediate which are folded into contact with each other. The mailer so formed is then run through conventional Moore SPEEDISEALER® pressure seal equipment (as generally illustrated in U.S. Pat. No. 5,397,427) so that a pressure of about 100–200 psi is applied to the cohesive, to provide secure adhesion of the formed panels together. The pressure sensitive cohesive has numerous advantages over conventional heat seal adhesive and reweftable adhesive.

While mailer type business forms with pressure sensitive cohesive are extremely successful, there can be a significant problem in utilization thereof with conventional continuous laser printers. The standard arrangement of pressure sensitive cohesive included in the marginal portions of conventional mailer type business form, such as shown in U.S. Pat. Nos. 5,176,739, 5,174,493, 5,314,110, is elongated strips of cohesive provided in a staggered pattern on the face and the back of the form. This standard staggered pattern was created so that stacked sheets of the product would not block or stick together. However the provision of the cohesive on both faces (front and back) of the sheet can result in flexing of the edges, particularly the long edges (the side, vertical, edges when the sheet is in the "portrait" orientation). This flexing of the vertical edges is called "cupping" or distortion. This distortion can be so excessive at times that the forms cannot feed properly, jam, or cause misfolds on some printers. The problem is compounded because many different paper stocks can be utilized with pressure sensitive cohesive. In addition the cupping on the vertical edges can cause problems in post-processing, including misfeeds, jams, and double feeds. In many post-processing situations the vertical edge of the form is actually the lead edge, such as when processing through a detacher, a transport station, or a folder/sealer (which either V-folds, C-folds, or Z-folds the form and then applies the necessary pressure to activate the cohesive).

According to the present invention, a mailer type business form intermediate is provided which overcomes the cupping problem associated with conventional pressure sensitive cohesive intermediates, so that improper feeding, jamming, and misfolding of the sheet forming the business form intermediate is substantially avoided. This is accomplished according to the present invention by providing a particular pattern of the pressure sensitive adhesive along the vertical edges of the intermediate, preferably in the form of substantially rectangular spots that are spaced apart a distance at least as great as the length thereof, but provide a secure sealing action rather than merely "tacking" the form together. While rectangular spots of pressure sensitive cohesive have been utilized before in business form intermediates (such as shown in U.S. Pat. No. 5,294,041), they have not necessarily been dimensioned or positioned to avoid the cupping problem. Rather they have typically been staggered or spaced so that adhesive on any form length does not contact adhesive on any adjacent form length when the continuous form is fan folded about longitudinal fold lines, which is an approach distinct from that according to the invention.

According to the present invention in the preferred embodiment of the intermediates according to the invention, the pattern which avoids the cupping problem is the provision of a series of substantially rectangular spots of pressure activated adhesive each having a first dimension parallel to the vertical edges of the intermediate of about 0.2–0.3 inches (preferably about 0.25 inches), and a second dimension perpendicular to the first dimension of between about 0.1–0.15 inches (typically about 0.125 inches), with the spots substantially regularly spaced from each other parallel to the vertical edges a distance of between about 1–3 times the first dimension (preferably spaced from each other about twice the first dimension, e.g. about 0.5 inches). Typically at least six spots (and normally about 8–18) are provided on the first face and at least four spots (and normally about 6–12) on the second face. Preferably all of the spots within each margin portion are in a substantially straight line, and may have uniform size and spacing, although if a few spots have a slightly different size or spacing in order to accommodate the requirements of a particular form (such as a spot extending across a fold line, which spot has a first dimension of greater than 0.3 inches but less than about 0.75 inches), cupping problems still can be avoided under most circumstances.

According to one aspect of the present invention a mailer type business form intermediate is provided comprising following conventional components: A substantially quadrate sheet of paper having first and second faces, top and bottom edges substantially parallel to each other, and first and second side edges substantially perpendicular to the top and bottom edges and substantially parallel to each other. The top and bottom edges spaced a first distance, and the side edges spaced a second distance, less than (or equal to) the first distance. First and second lines of weakness formed in the sheet adjacent, but spaced from and substantially parallel to, the first and second side edges, respectively, to define first and second removable side margin portions. A first fold line formed in the sheet substantially parallel to the top and bottom edges, and defining the sheet into panels on opposite sides thereof. What is unique according to the present invention is a pattern of pressure activated cohesive in each of the side margin portions on at least the first face, the patterns for substantially preventing cupping so that improper feeding, jamming, and misfolding of the sheet is substantially avoided. The details of the patterns, comprising series of substantially rectangular spots, is preferably as described above.

Also according to the present invention for many different embodiments (particularly C-folded or Z-folded embodiments) a series of the spots are provided on the second face of the sheet in the margin portions in a same panel as the series of spots in the first face. In this situation the spots on the second face do not significantly overlap the spots on the first face (that is if that they overlap at all it is less than a tenth of an inch). Also according to the present invention the quadrate sheet is typically provided in continuous form format with a second (and more) quadrate sheet substantially identical to the first sheet except for the positioning of the spots, the first and second sheets separated by a line of weakness (such as a perforation line) between the second side edge of the first sheet and the first side edge of the second sheet. The spots on the first face of the second sheet are staggered with respect to the spots on the first face of the first sheet, which facilitates feeding especially in post processing (after passage through a continuous laser printer), and also helps avoid the cupping problem. Separable tractor drive margin portions may be provided adjacent and parallel to the top and bottom edges of each sheet (the tractor drive margin portions are typically cut off with a slitter before mailing of the mailer formed from the intermediate).

First and second longitudinal lines of weakness are also typically provided substantially parallel to and adjacent the top and bottom edges and defining a top and bottom margin in the sheets, and patterns of pressure activated cohesive may be disposed on the top and bottom portions. The patterns in the top and bottom margins may be conventional strips of pressure activated cohesive rather than the spaced spots that are provided in the side margins. The strips of cohesive may be provided on the first face in one of the top and bottom margins, and strips of cohesive on the second face in the other of the top and bottom margins.

Except for intermediates which are designed to be V-folded to produce the mailers, and particularly for C-fold, Z-fold, or double fold intermediates, a second fold line (or other additional fold lines) is provided parallel to the first fold line so that the first and second fold lines define the sheet into at least three panels. Under some circumstances adjacent at least one of the fold line spots may be provided on opposite sides of the fold line in a side margin which are spaced from each other a distance less than the first dimension, or at least one spot in the series in each side margin may extend across a fold line and have a first dimension that is longer than the spots in the series (e.g. greater than 0.3 inches but less than about 0.75 inches). A first series of spots may be provided in the side margins on the first face of the first and second panels, and a second series of spots provided in the side margin on the second face of the second and third panels for Z-folded constructions. The fold lines and the series of spots are provided so that the spots of the series align with each other when the sheet is Z-folded about the fold lines (including eccentrically Z-folded), or C-folded, depending upon the particular construction utilized.

The invention also relates to a method of producing imaged mailers from mailer type business form intermediates such as described above. For example the method may comprise the steps of: Stacking the intermediates in a tray of a laser printer, and feeding the intermediates one at a time from the tray through the laser printer so that the side edges of the intermediate do not cup; imaging at least one face of each of the intermediates; ultimately folding the sheet about the at least one fold line to form a mailer; and then passing each mailer through a pressure sealer to act on the pressure cohesive to apply a sealing pressure of at least about 100 psi to each mailer to seal each intermediate into a mailer.

According to another method of the present invention imaged mailers are produced from mailer type business form intermediates by the steps of: Feeding the intermediates, using the tractor drive holes, one at a time through a continuous laser printer so that the side edges of the intermediate do not cup; imaging at least one face of each of the intermediates; ultimately severing the tractor drive openings from the sheets and separating the sheets from each other, and folding each of the sheets about the at least one fold line to form a mailer; and then passing each mailer through a pressure sealer to act on the pressure cohesive to apply a sealing pressure of at least about 100 psi to each mailer to seal each intermediate into a mailer.

According to yet another aspect of the present invention imaged mailers are produced from mailer type business form intermediates by the steps of: Feeding the intermediates one at a time through a laser printer so that the side edges of the intermediate do not cup; imaging at least one face of each of the intermediates; ultimately Z folding or C folding (eccentrically or non-eccentrically) the sheet about the fold lines to form a mailer; and then passing each mailer through a pressure sealer to act on the pressure cohesive to apply a sealing pressure of at least about 100 psi to each mailer to seal each intermediate into a mailer.

It is the primary object of the present invention to provide advantageous mailer type business form intermediates having pressure activated cohesive, and methods of producing imaged mailers in an advantageous manner from such intermediates. This and other objects of the invention will become clear from an inspection of the detailed description of the invention, and from the appended claims.

DETAILED DESCRIPTION OF THE DRAWINGS

Figure 1:
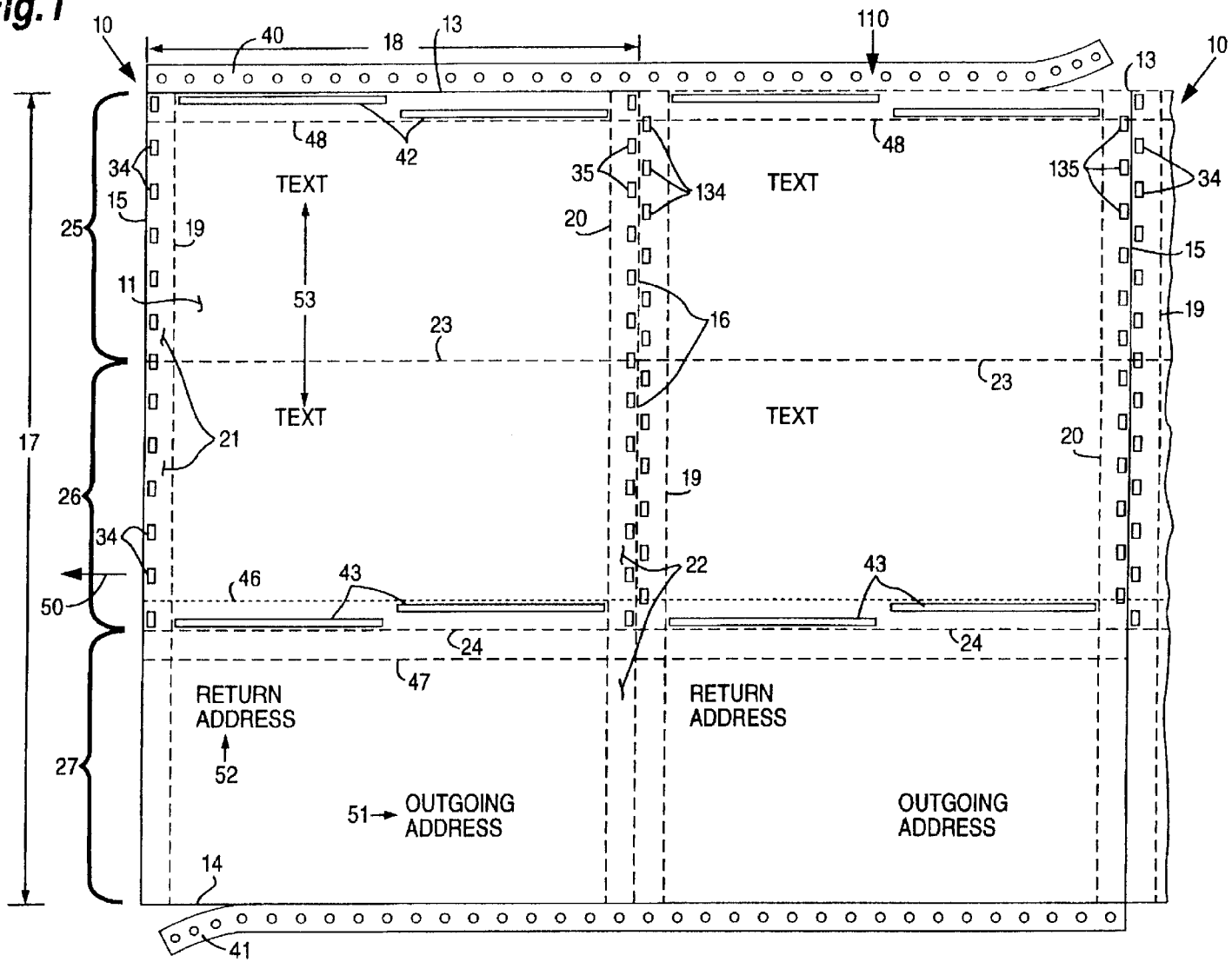
FIG. 1 is a schematic top plan view of an exemplary mailer type business form intermediate according to the present invention in combination with other like intermediates.

FIGS. 1 through 4 illustrate an exemplary mailer type business form intermediate 10 according to the present invention, the intermediate 10 being designed to be Z-folded about fold lines to produce a mailer type business form. Except for the pattern of pressure activated cohesive, the intermediate 10 is substantially conventional.

The intermediate 10 comprises a substantially quadrate sheet of paper having a first face 11 (FIG. 1) and a second face 12 (FIG. 2) with top 13 and bottom 14 edges substantially parallel to each other, and first and second side edges 15, 16, respectively, substantially perpendicular to the edges 13, 14 and substantially parallel to each other. The top and bottom edges 13, 14 are spaced a first distance 17 (see FIG. 1) while the side edges 15, 16 are spaced a second distance 18 (see FIG. 1) less than the first distance 17. The distances 17, 18 may vary widely depending upon the particular form being utilized. However the most common dimensions are about 8 ½ inches, or about 9 ½ inches, for the distance 18, and about 11 inches, or about 14 inches, or about 14 ⅞ inches (considering the tractor drive strips which will be described hereinafter) for the distance 17.

First and second lines of weakness 19, 20 are formed in the sheet 10 adjacent, but spaced from and substantially parallel to, the sides edges 15, 16, respectively, to define first and second removable side margin portions 21, 22, respectively. A first fold line 23 is provided substantially parallel to the edges 13, 14, and defines the sheet 10 into panels on opposite sides thereof. If the mailer to be produced from the intermediate 10 is a V-fold mailer, then only the one fold line 23 will be provided. However more commonly C-fold (both eccentric and noneccentric), Z-fold (both eccentric and non-eccentric), double fold, and like mailers are typically provided, in which case there is at least a second fold line 24 parallel to and spaced from the first fold line 23, so that the intermediate 10 is defined into three or more panels 25, 26, 27 (comprising first through third panels, respectively). The intermediate 10 illustrated in FIGS. 1 through 4 is a non-eccentric Z-fold intermediate.

The lines of weakness 19, 20 may be any suitable lines of weakness but preferably are perforation lines. The fold lines 23, 24 may be any suitable fold lines including creases, score lines, or the like, but preferably are perforation lines.

The pattern of the pressure activated cohesive in the side margins 21, 22 is what is unique about the intermediate 10 illustrated in FIGS. 1 through 4. The pressure activated cohesive per se is conventional, as shown in U.S. Pat. Nos. 4,918,128 and 5,427,851, and as otherwise disclosed in U.S. Pat. No. 5,201,464 (which has been incorporated by reference herein). However instead of providing staggered strips, or staggered spots, of the pressure activated cohesive, according to the present invention patterns of pressure activated cohesive are provided in the side margins 21, 22 on at least the first face 11 of the intermediate 10 for substantially preventing cupping (also known as flexing or distortion) of the edges 15, 16, so that improper feeding, jamming, and misfolding of the sheet 10 is substantially avoided, both when passing through a conventional laser printer (such as a continuous laser printer as illustrated schematically at 29 in FIG. 12), or when passing through conventional post-processing equipment (such as a conventional detacher as illustrated schematically at 30 in FIG. 12, and/or a conventional folder such as illustrated schematically at 31 in FIG. 12, a conventional pressure sealer, such as a SPEEDISEALER® sealer available from Moore U.S.A. of Lake Forest, Ill., as illustrated schematically at 32 in FIG. 12).

Figure 3:
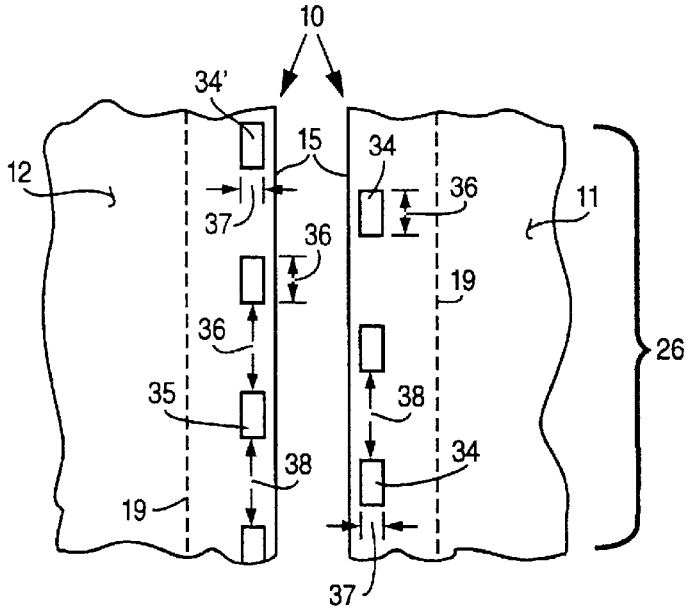
FIG. 3 is a detail enlarged view showing the desired exemplary pattern of pressure activated cohesive in the intermediate of FIGS. 1 and 2, with the opposite faces of the same intermediate adjacent each other for clarity of illustration of the relative positioning of the pattern spots.

As can be seen in FIG. 1, but is most clear in FIG. 3, the desired cohesive pattern according to the preferred embodiment of the present invention comprises a series (at least six, typically 8–18) of substantially rectangular spots 34 in the side margin 21, and like spots 35 in the side margin 22. The spots 34, 35 are preferably aligned with each other along the length 17 of the intermediate 10, and each spot has a first dimension 36 (see FIG. 3) parallel to the side edge 15 of about 0.20–0.3 inches (preferably about 0.25 inches), and a second dimension 37 parallel to the edges 13, 14 of about 0.1–0.15 inches (preferably about 0.125 inches). The spots 34, 35 are spaced from each other parallel to the side edges 15, 16 a distance 38. The distance 38 is small enough so that an actual seal is provided along the edges 15, 16 rather than merely a "tack" (that is a secure seal rather than one that may be easily separated by sticking one's finger and implement between the spots and quickly separating them), but large enough so that the cupping problem is avoided. The distance 38 is preferably between about 1–3 times the dimension 36 and most preferably is about twice the dimension 36 (i.e. the spacing 38 is about 0.5 inches when the preferred first dimension 36 of 0.25 inches is used). While only the spots 34 are seen in FIG. 3 it is to be understood that the spots 35 are similarly—preferably identically—dimensioned and spaced.

As seen clearly in FIGS. 1 through 4, preferably all of the spots 34, 35 within each margin portion 21, 22 are in a substantially straight line, as opposed to staggered, and preferably are immediately adjacent the side edges 15, 16 (that is closer to the side edges 15, 16 than to the perforation lines 19, 20).

Figure 2:
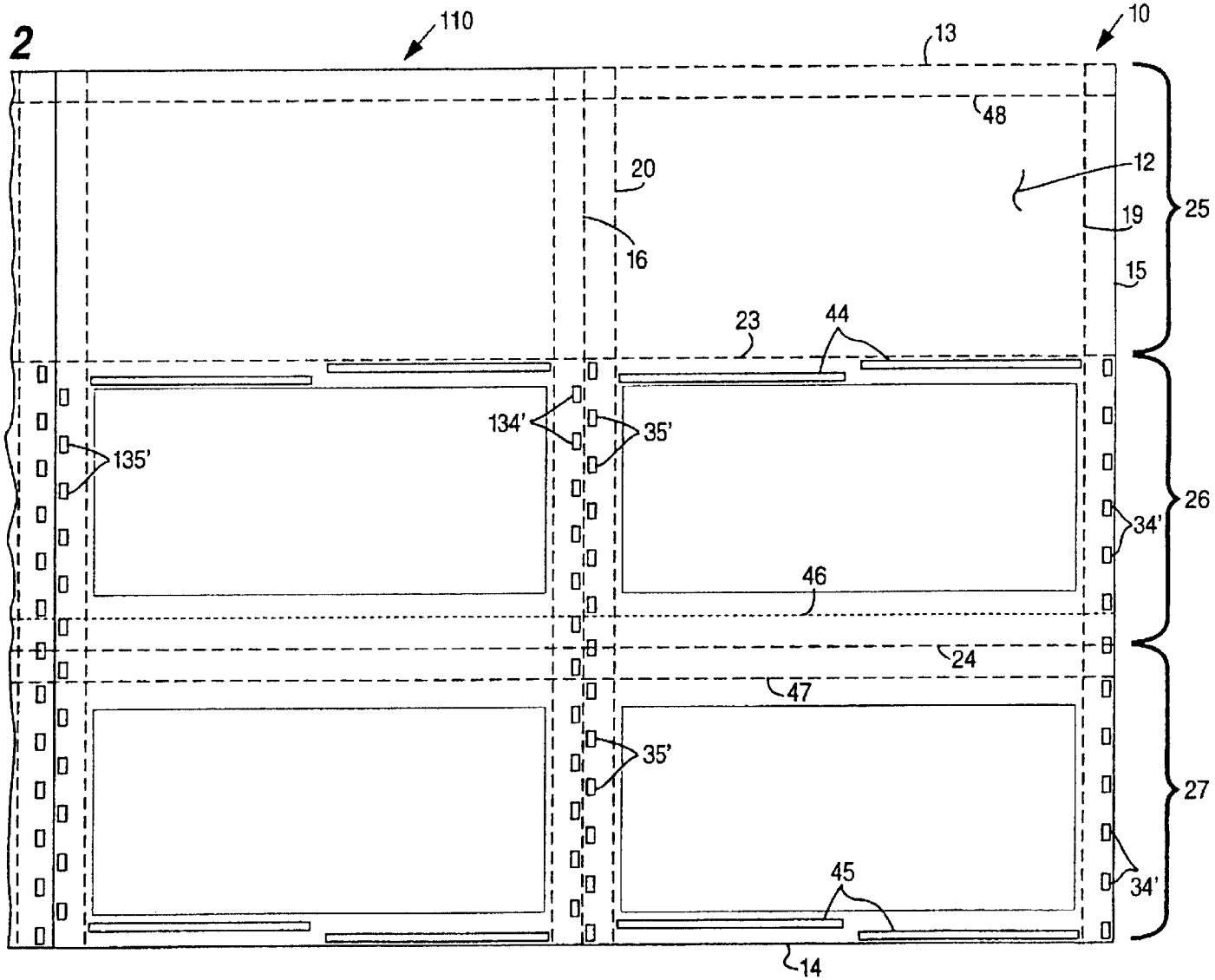
FIG. 2 is a bottom view of the intermediates of FIG. 1 with the tractor drive strips removed.

As seen in FIG. 2, preferably a series of spots of pressure activated cohesive are also preferably provided on the second face 12. In FIG. 2 (and also in FIG. 3) the spots on the second face 12 adjacent the side edge 15 are indicated by reference numerals 34', while those adjacent the side edge 16 are indicated by the reference numeral 35'. As most easily seen in FIG. 3, the spots 34' (at least four are normally provided, typically about 6–12) are substantially identical to the spots 34, but are positioned so that they do not significantly overlap the spots 34. For example, for the embodiment illustrated in FIG. 3, the spots 34 only overlap very slightly (less than 0.1 inch) the spots 34 aligned therewith on the first face 11, but preferably there is no overlap at all. Spacing from one face 11 to the other 12 is preferably accomplished without staggering in the dimension of elongation of the edges 13, 14; that is the spots 34'—like the spots 34—are immediately adjacent the side edge 15, being closer to the side edge 15 than the perforation line 19, and are in substantially a straight line.

In the embodiment illustrated in FIGS. 1 through 4, since a Z-fold mailer is provided, the spots 34, 35 are provided only in the first and second panels 25, 26 of the first face 11, while the spots 34', 35' are provided only in the second and third panels 26, 27 on the face 12. In FIG. 3 two intermediates 10 are illustrated with the top edges 13 thereof aligned and with the edges 15 thereof adjacent each other, one showing face 11 and the other showing face 12, at the second panel 26.

The intermediate 10 may also have various other features, a number of which are conventional. For example conventional tractor drive strips 40, 41 may be provided at the edges 13, 14 as illustrated in FIG. 1 (the tractor drive strips 40, 41 having been slit off and therefore not visible in FIG. 2). At some point during processing, typically after imaging and perhaps even after folding or sealing, the strips 40, 41 are removed, as by utilizing a conventional slitter.

Pressure activated cohesive patterns are preferably provided to hold the mailer ultimately formed along the edges 13, 14 and/or fold lines 23, 24 rather than merely relying upon the adhesive spots 34, 34', 35, 35'. For example in the Z-fold configuration illustrated in FIGS. 1, 2, and 4, elongated strips of pressure activated cohesive 42 are provided adjacent the top edge 13 on face 11 for cooperation with like strips 43 adjacent the second fold line 24, also on the first face 11; while on the second face 12 (see FIG. 2) cohesive strips 44 are provided which are adjacent the first fold 23 and cooperate with the cohesive strips 45 adjacent the bottom edge 14. Perforation lines 46, 47 are parallel to and straddle the second fold line 24, while perforation line 48 is adjacent and parallel to the top edge 13 with the cohesive strips 42 between the edge 13 and the perforation line 48. Similar perforation lines could be provided adjacent the strips 44 and 45, if desired.

FIG. 1 shows the intermediate 10 after it has passed—in the direction of arrow 50—through a continuous laser printer (e.g. 29 in FIG. 12) or the like so that address information—such as the outgoing address 51 and/or the return address 52—is imaged on the intermediate 10. For the construction illustrated in FIGS. 1 through 4, the addresses 51, 52 are imaged on the first face 11 of the third panel 27. Text to provide information to the addressee—which text is illustrated schematically at 53 in FIG. 1—may be imaged either using the continuous laser printer (29 in FIG. 12), or can have been preprinted before the intermediates 10 were supplied to the entity that will do the ultimate address imaging, detaching, etc.

FIGS. 1 and 2 show the intermediate 10 in combination with a second intermediate 110 which is essentially identical to the intermediate 10 except preferably for the positioning of the patterns of cohesive. The intermediates 10, 110 are connected to each other by a line of weakness, such as a perforation line, 16, which will form the second side edge of the intermediate 10, and a first side edge of the intermediate 110, when detached (e.g. using a conventional detacher illustrated schematically at 30 in FIG. 12). Because the intermediate 110 is substantially identical to the intermediate 10 the components thereof that are the same as those of the intermediate 10 are shown by the same reference numeral, while those that are slightly different are shown by the same reference numeral only preceded by "1".

As earlier indicated, preferably the only significant difference between the intermediate 110 and the intermediate 10 is the particular positioning of the spots 134, 135, 134', 135', of pressure activated cohesive. The spots 134 are staggered in the length dimension 17 with respect to the spots 35, and the spots 135 staggered in the length dimension 17 with respect to the spots 34 (and similarly for the spots 134' and 35', and 135' and 34'), so that there is little, and preferably no, overlap between them in the length dimension 17. Therefore even if the combination of intermediates as illustrated in FIG. 1 is fanfolded about the lines/edges 15, 16 there will be no significant overlap of pressure activated cohesive spots (that is the spots 34, 135 will not engage each other, nor will the spots 35, 134, and similarly for the spots on the face 12 as illustrated in FIG. 2).

FIGS. 1 and 2 show the intermediates 10, 110 as part of a continuous web (which may be fanfolded), the intermediates 10, 110 alternating over the entire length of the web.

Figure 4:
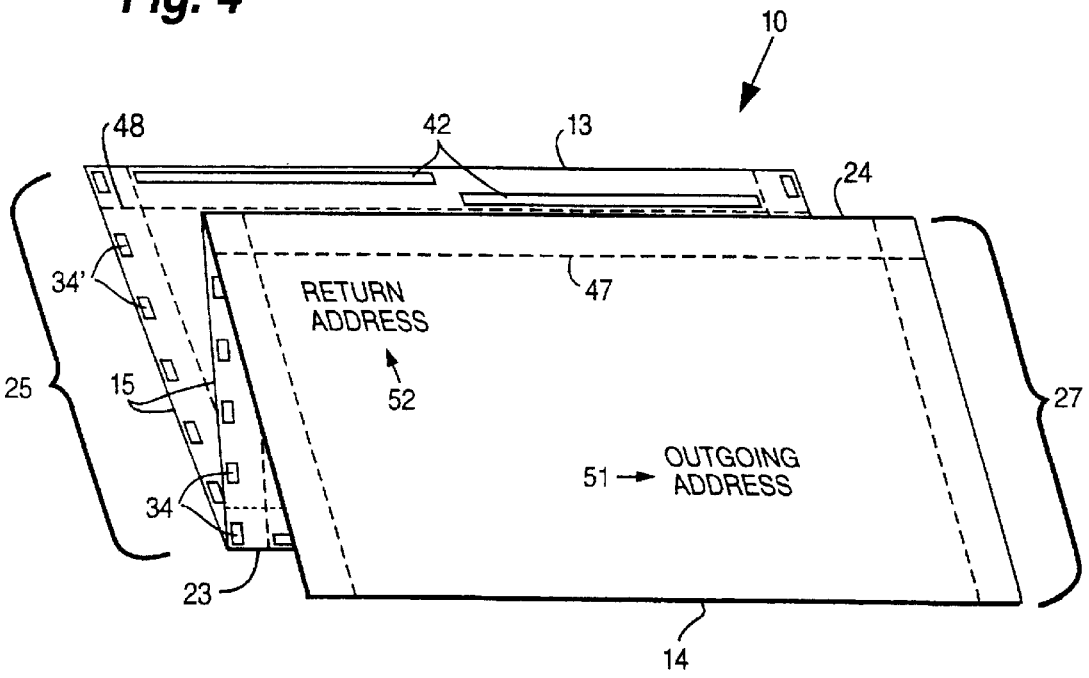
FIG. 4 is a top schematic perspective view showing the intermediate of FIGS. 1 through 3 being Z-folded to form a mailer type business form.

FIG. 4 illustrates Z-folding of the intermediate 10 about the fold lines 23, 24 after detachment from the intermediate 110 (and slitting off of the tractor drive strips 40, 41). It will be seen that the spots 34 on the first panel 25 will align with the spots 34 on the second panel 26 while the spots 35 on the first panel 25 align with the spots 35 on the second panel 26, and the spots 34' on the second panel 26 will align with the spots 34' on the third panel 27 while the spots 35' on the second panel 26 align with the spots 35' on the third panel 27. When in this configuration, then, the mailer of FIG. 4 is passed through the conventional SPEEDISEALER® equipment (illustrated schematically at 32 in FIG. 12, and such as shown generally in U.S. Pat. No. 5,397,427) so that a pressure of about 100–200 psi is applied to the cohesive (and preferably only to the cohesive strips, not to the entire mailer) to effect secure sealing of the panels 25–27 to form a mailer. The mailer may then be mailed or otherwise delivered.

Figure 6:
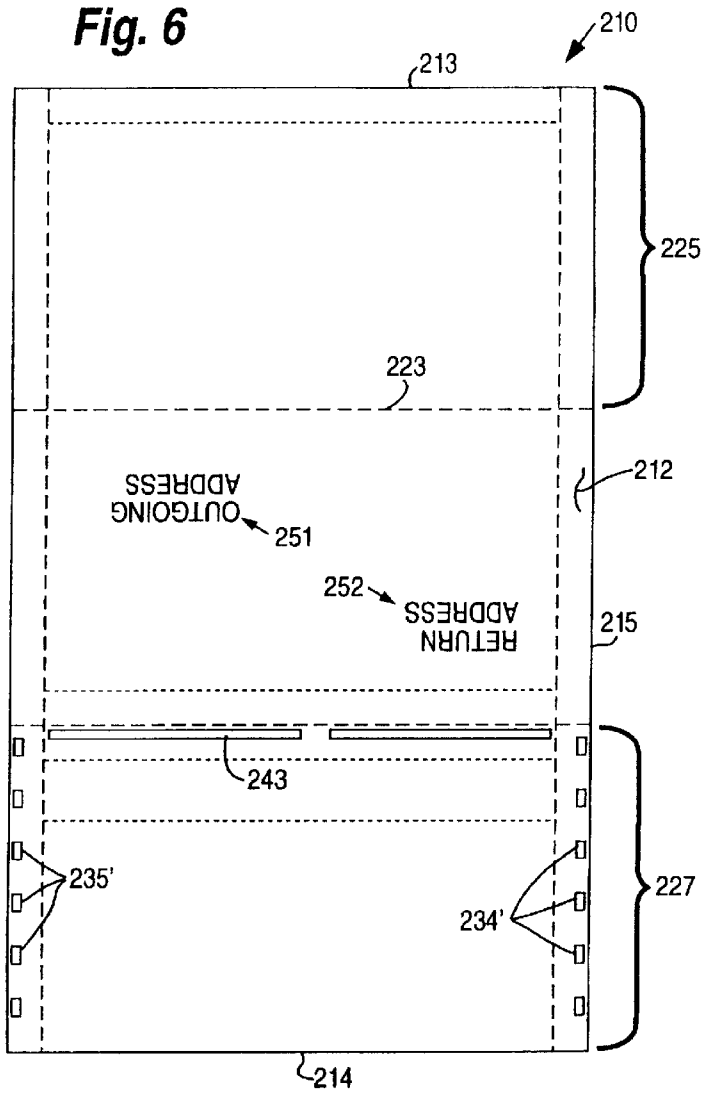
FIGS. 5 and 6 are schematic top plan and bottom plan views of a second exemplary intermediate of a mailer type business form according to the present invention.
Figure 5:
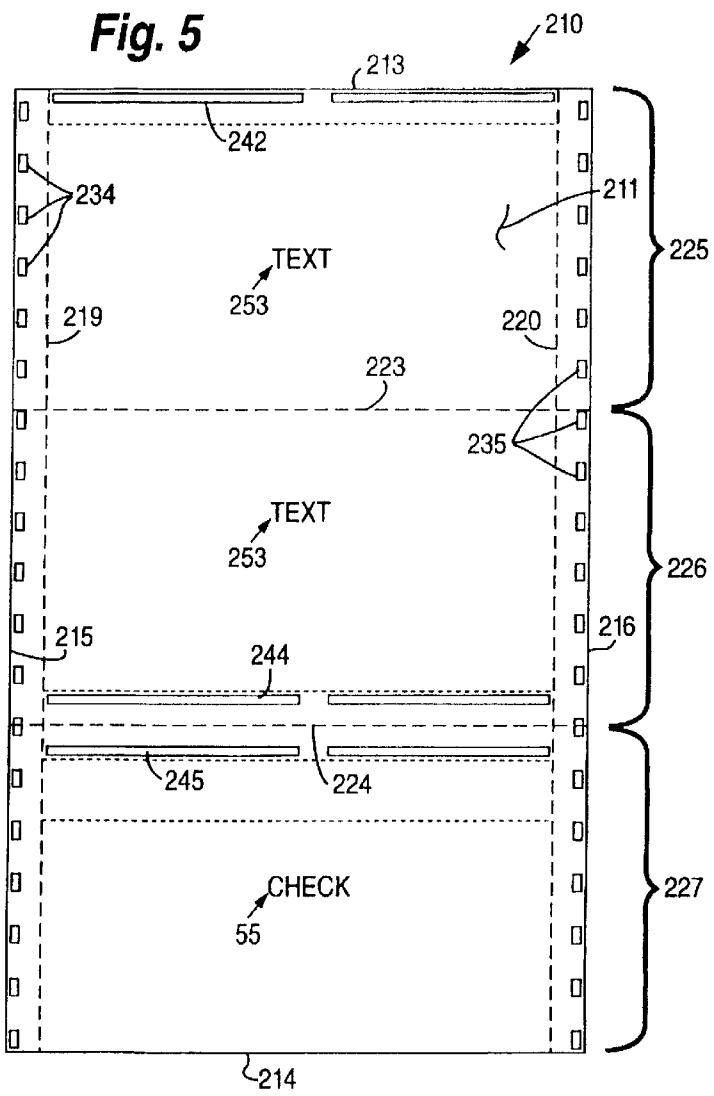
Figure 7:
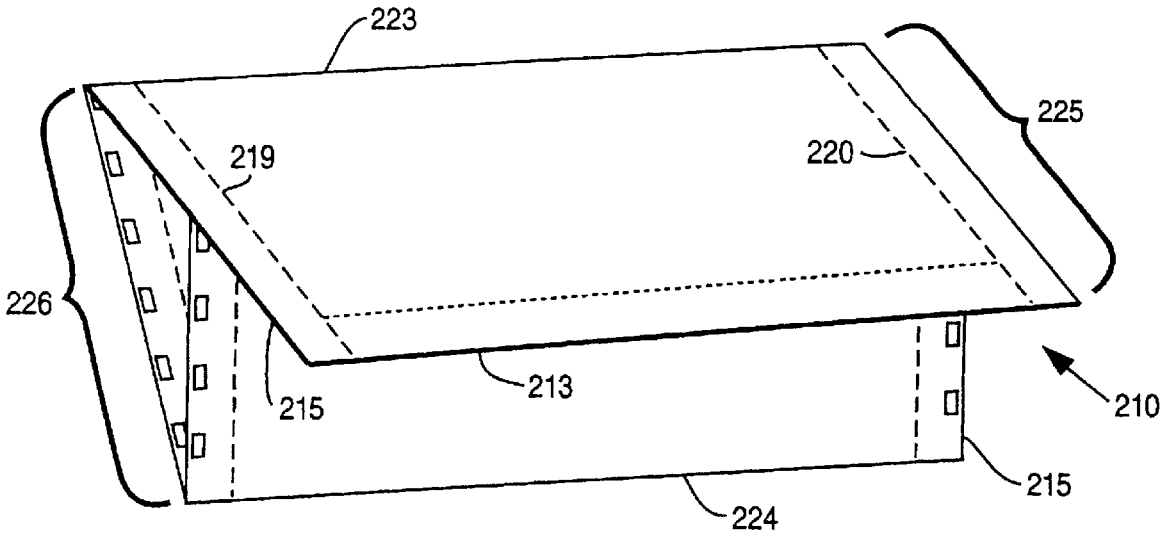
FIG. 7 is a view like that of FIG. 4 only showing the intermediate of FIGS. 5 and 6 being C-folded to form a C-folded mailer.

FIGS. 5 through 7 illustrate a second embodiment according to the invention, this embodiment being a conventional C-fold mailer, except for the patterns of cohesive. In the FIGS. 5 through 7 embodiment the same two digit reference numerals are used for like components in the FIGS. 1 through 4 embodiment, only preceded by the numeral "2".

The intermediate 210 of FIGS. 5 through 7 has a series of cohesive spots 234, 235 disposed substantially along the entire lengths of the side edges 215, 216 as illustrated in FIG. 5 for the face 211, while the spots 234', 235' are provided only in the third panel 227. In this embodiment the address indicia 251, 252 are imaged on the second face 212 of the second panel 226 (see FIG. 6), while text 253 is imaged on the face 211 of the panels 225, 226, as well as optionally on the face 211 of the panel 227 (the indicia thereon may be different, such as the bank check or draft indicia illustrated schematically at 55 in FIG. 5). As seen in this embodiment when the intermediate 210 is C-folded—as illustrated schematically in FIG. 7—about the fold lines 223, 224, the spots 234 of the second panel 226 cooperate with the spots 234 of the third panel 227, and similarly the spots 235 of the second panel 226 cooperate with the spots 235 of the third panel 227, while the strips 242, 243 cooperate with each other; and the spots 234' on the third panel 227 cooperate with the spots 234 on the first panel 225, and the spots 235' on the third panel 227 cooperate with the spots 235 on the first panel 225, and the strips 244, 245 cooperate with each other.

Figure 8:
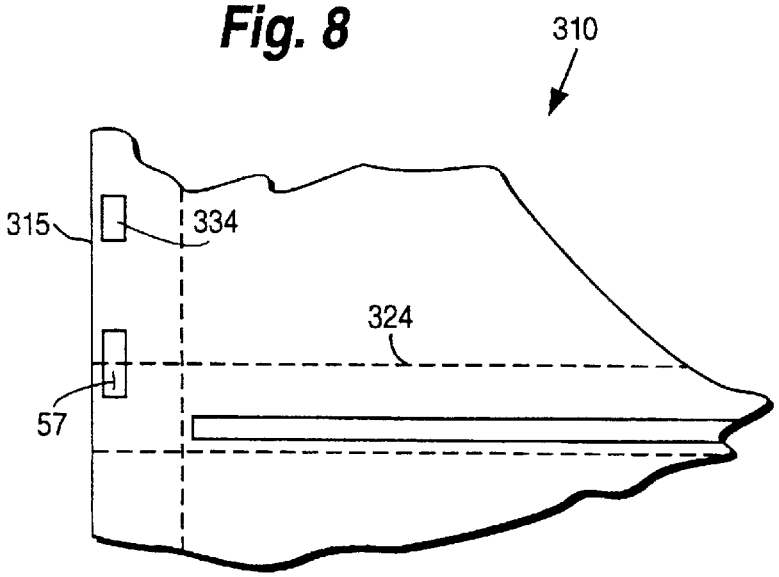
FIG. 8 is a detail view showing exemplary aberrations in the pattern of pressure activated cohesive that may be provided in an intermediate according to the present invention.

FIG. 8 shows a minor modification that may be provided according to the invention. Rather than all of the spots 34 (or 234, 35, 235, 34', 234', 35', 235') being entirely regular in dimension and spacing, the spacings and dimensions may vary slightly at particular points in the forms. In this embodiment structures comparable to those in FIG. 1 are shown by the same two digit reference numeral preceded by a "3". For example in FIG. 8 for an intermediate 310 at a perforation 324 a spot of cohesive 57 is illustrated that has a first dimension (along the side edge 315) that is slightly greater than the dimension of the spot 334 in the first dimension, for example the first dimension of the spot 57 being between about 0.3–0.75 inches, and in the embodiment illustrated in FIG. 8 traversing fold line 324. In some circumstances the spacing (comparable to the spacing 38 in FIG. 3) may be changed between one or more spots compared to the majority of the spots in order to properly and effectively fit the form, or to take into account where particular fold lines or perforation lines are located.

Figure 9:
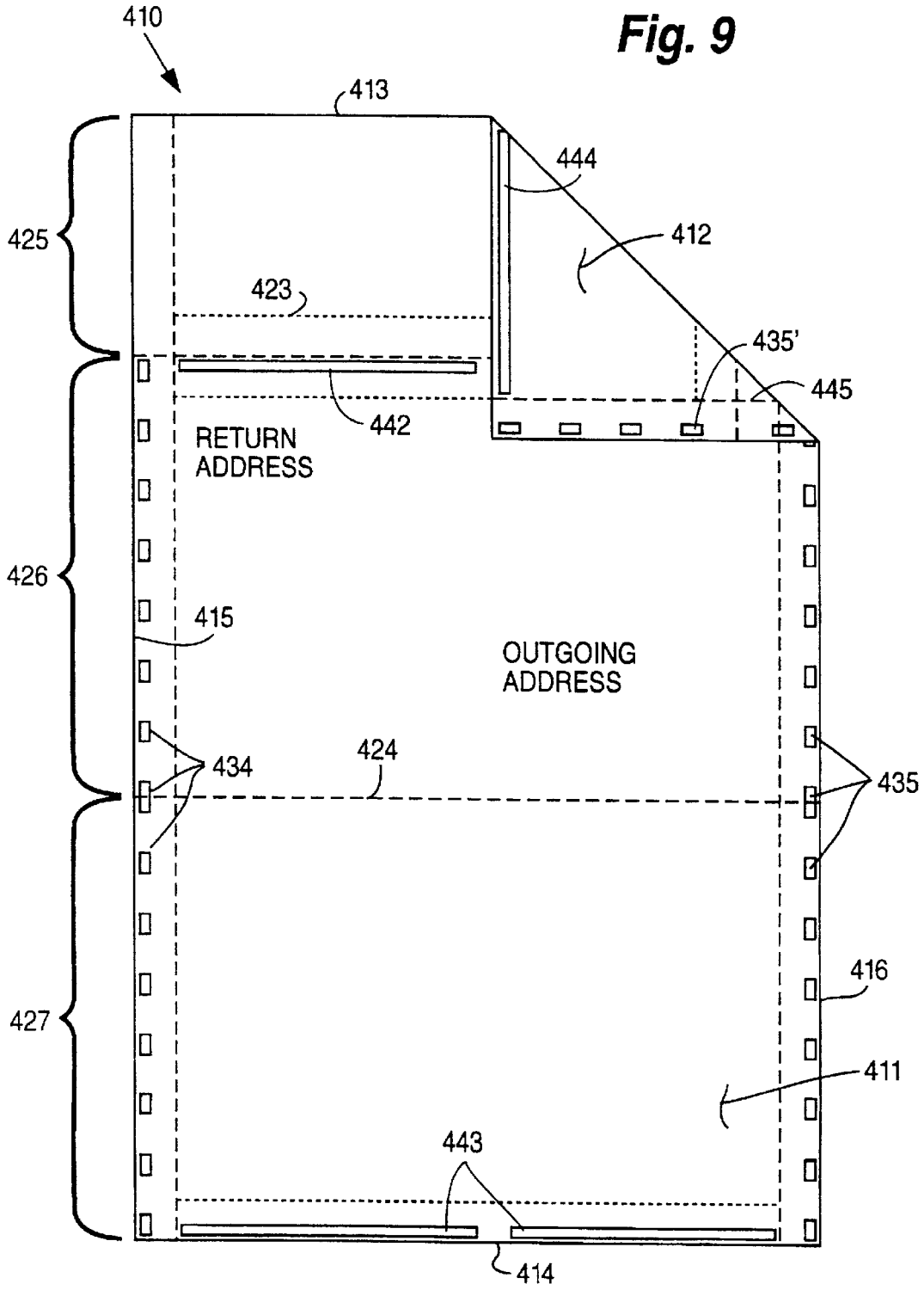
FIG. 9 is a top plan view, with one edge curled back to show the bottom, of another exemplary embodiment of a mailer type business form intermediate according to the present invention (designed to be eccentrically Z-folded)

FIG. 9 illustrates another intermediate 410 according to the present invention, the components therein comparable to those in the FIGS. 1 through 4 embodiment illustrated by the same two digit reference numeral only preceded by a "4". The embodiment in FIG. 9 is an eccentric Z-fold embodiment so that the first panel 425 has a length dimension (along the side edges 415, 416) which is less than the lengths of the panels 426, 427 (which are substantially the same as each other). In this way when eccentric Z folding about the fold lines 423, 424 takes place the spots 434 on the panels 426, 427 cooperate with each other while the spots 435 on the panels 426, 427 similarly cooperate, while the spots 435' and 434' (not shown) on the second face 412 of the panels 425, 426 cooperate. Similarly the strips 442 cooperate with the strips 443, while the strips 444, 445 cooperate.

Figure 10:
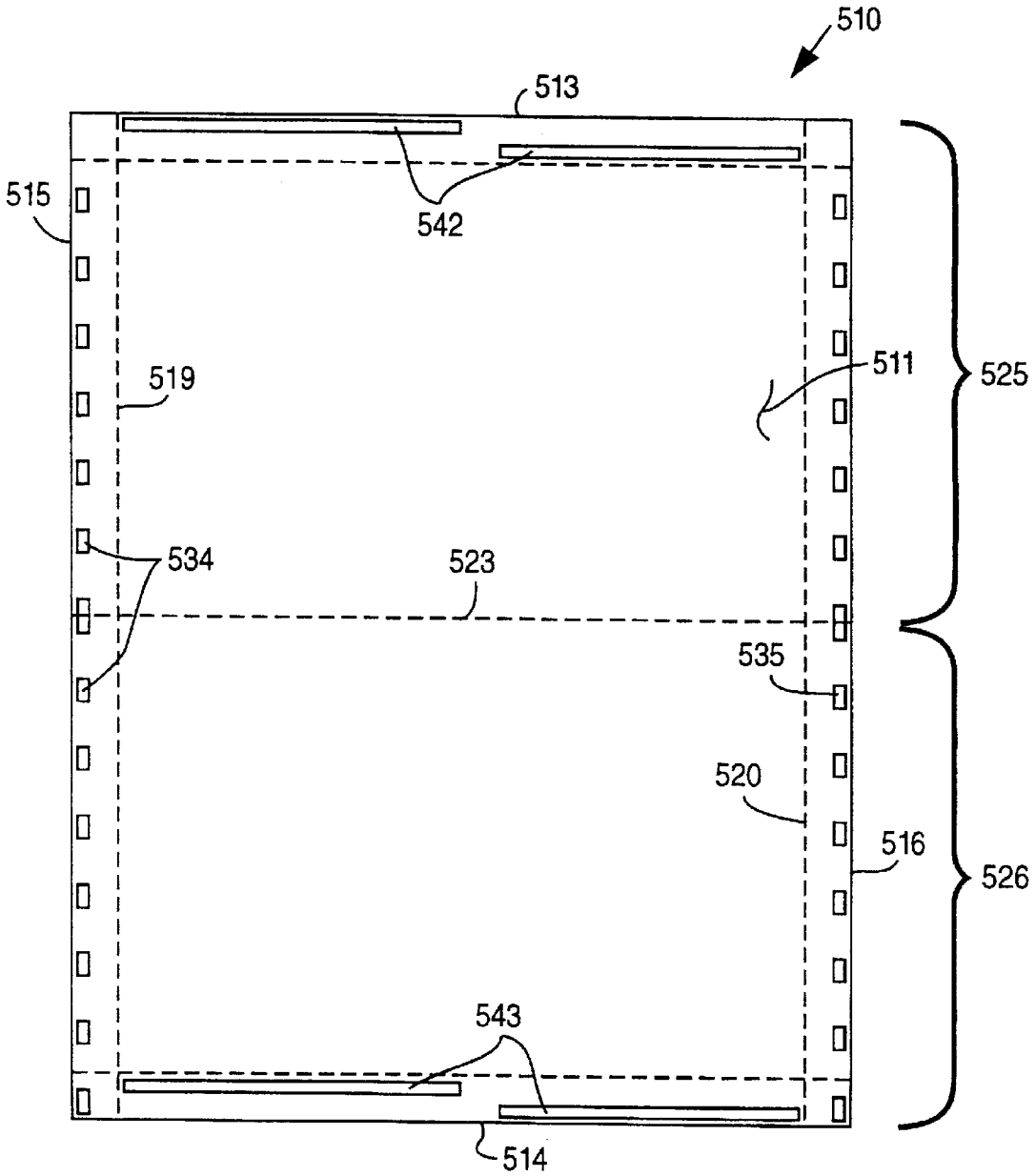
FIG. 10 is a top plan schematic view of another exemplary intermediate according to the present invention, this one designed to be V-folded.
Figure 11:
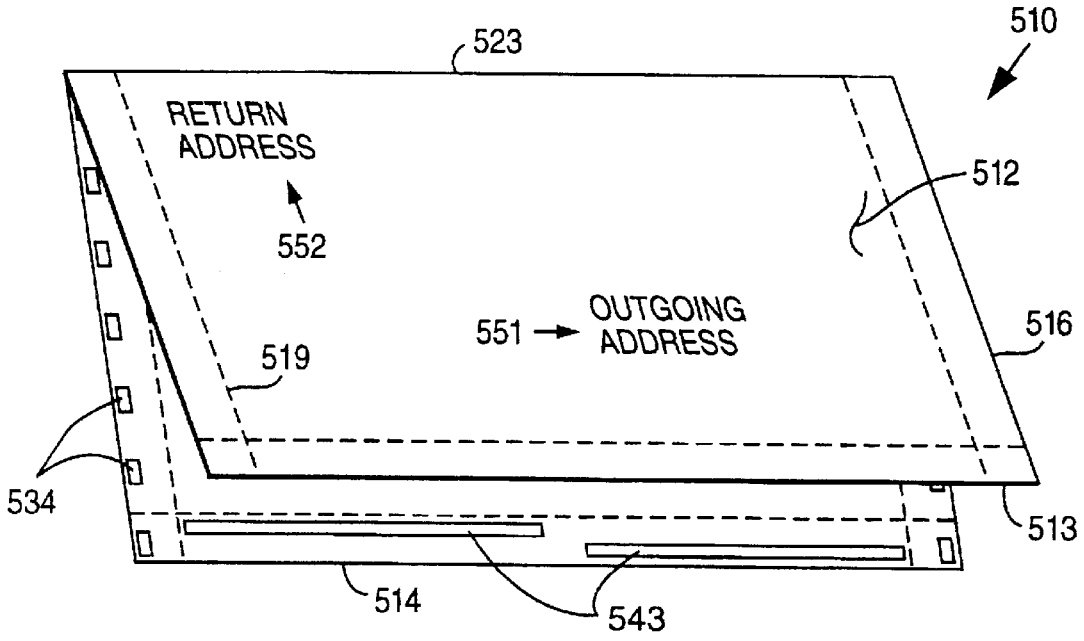
FIG. 11 is a top perspective schematic view showing the V-folding of the intermediate of FIG. 10 to produce a V-folded mailer according to the present invention.

FIGS. 10 and 11 show another embodiment of intermediate 510 according to the invention. In this embodiment components comparable to those in the FIG. 1 embodiment are shown by the same two digit reference numeral only preceded by a "5".

The embodiment 510 of FIGS. 10 and 11 is a V-fold embodiment, so that only a single fold line 523 is provided. The intermediate 510 is shown being V-folded in FIG. 11 so that the spots 534 in the panel 525 cooperate with the spots 534 in the panel 526, and similarly the spots 535 in the panel 525 cooperate with the spots 535 in the panel 526, and the strips 542 cooperate with the strips 543. In this embodiment the address indicia 551, 552 is imaged on the face 512 of the first panel 525, as seen in FIG. 11.

It should also be understood that other modifications may also be provided according to the invention. For example eccentric C-fold intermediates may be provided, as well as double fold intermediates, or other multiple fold intermediates (including double Z-fold).

Figure 12:
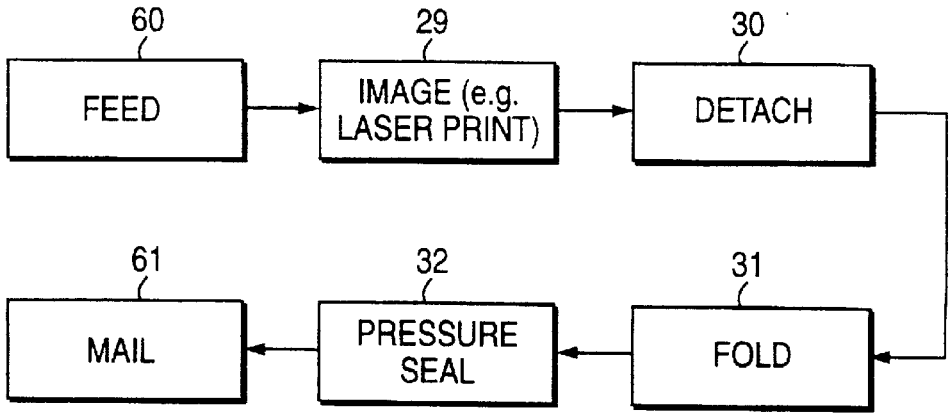
FIG. 12 is a schematic block diagram illustrating the various method steps that may be utilized in the practice of exemplary methods according to the present invention.

In the construction and utilization of all of the intermediates 10, 110, 210, 410, 510 as described above, the basic method of operation is schematically illustrated in FIG. 12. The intermediates 10, 210, etc. are fed—as illustrated schematically at 60 in FIG. 12—to the imaging station 29 (e.g. a conventional continuous or sheet fed laser printer), being fed in either a continuous format (as seen in FIG. 1, in the direction of the arrow 50), or in sheet format, either from a fan-folded stack or individual sheets in a tray. After imaging, such as the address information 51, 52 and perhaps text 53, on one or both faces 11, 12, using the laser printer at station 29, if the intermediates are in continuous format (as seen at 10, 110 in FIGS. 1 and 2) they are detached as illustrated at 30 using a conventional detacher. Ultimately they are folded and sealed, as illustrated schematically by stages 31, 32. The folding and sealing stages 31, 32 can be incorporated in the same piece of conventional equipment, the folding being either V-folding, C-folding, Z-folding, or the like, and the pressure sealing at station 32 applying a pressure of about 100–200 psi to the cohesive spots or strips to securely seal them together. Then the mailers so produced are mailed or otherwise distributed as illustrated schematically at station 61 in FIG. 12.

It will thus be seen that according to the present invention an exemplary mailer type business form intermediate, and method of utilization thereof, to produce imaged mailers, have been provided which are advantageous compared to the prior art. In the practice of the method according to the invention cupping of the side edges (e.g. 15, 16) is substantially eliminated both during imaging (e.g. through a laser printer 29) or in subsequent detaching, folding, and like operations (e.g. as illustrated schematically at 30, 31, in FIG. 12). This is accomplished according to the invention without introducing any unnecessary complications into the system, and in fact even allows slightly less cohesive to be utilized than in the prior art, for each intermediate. While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent products and methods.

What is claimed is:

1. A method of producing imaged mailers from mailer type business form intermediates comprising: a substantially quadrate sheet of paper having first and second faces, top and bottom edges substantially parallel to each other, and first and second side edges substantially perpendicular to the top and bottom edges and substantially parallel to each other; the top and bottom edges spaced a first distance, and the side edges spaced a second distance, less than the first distance; first and second lines of weakness formed in the sheet adjacent, but spaced from and substantially parallel to, the first and second side edges, respectively, to define first and second removable side margin portions; at least one fold line, including a first fold line formed in the sheet substantially parallel to the top and bottom edges, and defining the sheet into panels on opposite sides thereof; and a pattern of pressure activated cohesive in each of the side margin portions on at least the first face, the patterns for substantially preventing cupping so that improper feeding, jamming, and misfolding of the sheet is substantially avoided;

said method comprising the steps of: stacking the intermediates in a tray of a laser printer, and feeding the intermediates one at a time from the tray through the laser printer so that the side edges of the intermediate do not cup; imaging at least one face of each of the intermediates; ultimately folding the sheet about the at least one fold line to form a mailer; and then passing each mailer through a pressure sealer to act on the pressure cohesive to apply a sealing pressure of at least about 100 psi to each mailer to seal each intermediate into a sealed mailer.

2. A method as recited in claim 1 wherein the mailer includes first and second fold lines; and wherein said folding step is practiced so as to eccentrically C-fold the mailer about first and second fold lines.

3. A method as recited in claim 1 wherein the mailer includes first and second fold lines; and wherein said folding step is practiced so as to C-fold the mailer about first and second fold lines.

4. A method as recited in claim 1 wherein the mailer includes first and second fold lines; and wherein said folding step is practiced so as to eccentrically Z-fold the mailer about first and second fold lines.

5. A method as recited in claim 1 wherein the mailer includes first and second fold lines; and wherein said folding step is practiced so as to Z-fold the mailer about first and second fold lines.

* * * * *